US007733272B2

(12) United States Patent
Kurashima et al.

(10) Patent No.: US 7,733,272 B2
(45) Date of Patent: Jun. 8, 2010

(54) ANTENNA APPARATUS AND METHOD FOR FABRICATING THE SAME

(75) Inventors: Shigemi Kurashima, Shinagawa (JP); Takashi Yuba, Shinagawa (JP); Hideki Iwata, Shinagawa (JP); Masahiro Yanagi, Shinagawa (JP); Takashi Arita, Shinagawa (JP); Toshihiro Kusagaya, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 321 days.

(21) Appl. No.: 11/657,028

(22) Filed: Jan. 24, 2007

(65) Prior Publication Data

US 2008/0074325 A1 Mar. 27, 2008

(30) Foreign Application Priority Data

Sep. 22, 2006 (JP) ..... 2006-257782

(51) Int. Cl.
*H01Q 1/38* (2006.01)

(52) U.S. Cl. ..... 343/700 MS; 343/873; 343/906

(58) Field of Classification Search ..... 343/700 MS, 343/873, 909
See application file for complete search history.

(56) References Cited

U.S. PATENT DOCUMENTS 5,694,135 A * 12/1997 Dikun et al. ..... 343/700 MS
2004/0008143 A1* 1/2004 Mikami et al. ..... 343/713

FOREIGN PATENT DOCUMENTS

JP 2000-196327 7/2000

OTHER PUBLICATIONS

Takuya Taniguchi, Takehiko Kobayashi, "An Omnidirectional and Low-USWR Antenna for the FCC-Approved UWB Frequency Band", The 2003 IEICE General B-1-133, 2003, a copy and an English translation of which are enclosed herewith discloses a background art of the present invention.

* cited by examiner

*Primary Examiner*—Douglas W Owens
*Assistant Examiner*—Dieu Hien T Duong
(74) *Attorney, Agent, or Firm*—Staas & Halsey LLP

(57) ABSTRACT

An antenna apparatus is disclosed that includes an element member made of sheet metal, a ground member made of sheet metal, and a connection part that is integrally formed with the element member and the ground member.

6 Claims, 15 Drawing Sheets

241,242

ANTENNA APPARATUS AND METHOD FOR FABRICATING THE SAME

BACKGROUND OF THE INVENTION

1. Field of the Invention

The present invention relates to an antenna apparatus that includes an element member made of punched sheet metal.

2. Description of the Related Art

In recent years and continuing, much attention is being focused on UWB as a wireless communications technology enabling radar positioning and broadband communications, for example. In 2002, the U.S. Federal Communication Commission (FCC) approved usage of the UWB within a frequency band of 3.1-10.6 GHz.

The UWB is a wireless communications technology that involves transmitting pulse signals across a very wide frequency band. Therefore, an antenna used for UWB communication has to be capable of transmitting and receiving signals within a very wide frequency band.

It is noted that in "An Omnidirectional and Low-VSWR Antenna for the FCC-Approved UWB Frequency Band" by Takuya Taniguchi and Takehiko Kobayashi (The 2003 IECIE General Conference, B-1-133), an antenna adapted for use at least in the FCC-approved frequency band of 3.1-10.6 GHz is disclosed that comprises a ground plane and a feed element.

However, a conventional broadband antenna apparatus is constructed by arranging a cone-shaped or tear-shaped feed element on a flat ground plane. The antenna apparatus constructed in such a manner is rather large so that techniques for miniaturizing and flattening the antenna apparatus are in demand.

Also, with respect to technology related to a loop antenna adapted for low frequency band communication, Japanese Laid-Open Patent Publication No. 2000-196327 discloses an antenna apparatus that has a flexible substrate on which an element is formed by a conductive pattern.

However, the above-disclosed antenna apparatus uses a flexible substrate and also requires a connector for establishing connection with the exterior. Such an antenna apparatus has a relatively large number of components and the process for fabricating the antenna apparatus includes a large number of process steps so that low productivity and high manufacturing costs have been a problem.

SUMMARY OF THE INVENTION

According to an aspect of the present invention, an antenna apparatus having fewer components that can be fabricated at a lower cost and a method for fabricating such an antenna apparatus are provided.

According to one embodiment of the present invention, an antenna apparatus is provided that includes:

an element member made of sheet metal;

a ground member made of sheet metal; and a connection part that is integrally formed with the element member and the ground member.

In a preferred embodiment, the connection part may include an element terminal that is integrally formed with the element member and bent into a predetermined shape, and a ground terminal that is integrally formed with the ground member and bent into a predetermined shape. Further, the connection part further may include a resin part, and the element terminal, the ground terminal, and the resin part may form a connector. Further, the resin part may fix the element member and the ground member.

In another preferred embodiment, the element member and the ground member may be sealed by resin, and a portion of the element terminal and a portion of the ground terminal may be exposed through the resin.

In another preferred embodiment, the element member, the ground member, and the connection part may be adapted for broadband/ultra-wide band wave transmission/reception.

According to another embodiment of the present invention, an antenna apparatus is provided that includes:

an element member made of sheet metal; and an element terminal that is integrally formed with the element member.

According to another embodiment of the present invention, a method is provided for fabricating an antenna apparatus, the method including the steps of:

punching from a sheet metal an element member, a ground member, an element terminal connected to a feed point of the element member, and a ground terminal connected to the ground member; and bending the element terminal and the ground terminal into predetermined shapes; and arranging the element terminal and the ground terminal into a connection part for connecting the element member to an external circuit.

According to a preferred embodiment, a resin part may be molded together with the element terminal and the ground terminal to form the connection part.

According to another embodiment of the present invention, a method for fabricating an antenna apparatus, is provided, the method including the steps of:

punching from a sheet metal an element member and an element terminal connected to a feed point of the element member;

bending the element terminal into a predetermined shape; and arranging the element terminal into a connection part for connecting the element member to an external circuit.

According to an aspect of the present invention, by integrally forming an element terminal and/or a ground terminal with an element member and/or a ground member and arranging the element terminal and/or the ground terminal into a connection part, a separate connector may not have to be mounted so that the number of components making up the antenna apparatus may be reduced, process steps for mounting a connector may be omitted from the process of fabricating the antenna apparatus, and productivity may be increased, for example.

DESCRIPTION OF THE PREFERRED EMBODIMENTS

In the following, preferred embodiments of the present invention are described with reference to the accompanying drawings.

First Embodiment

Figure 1:
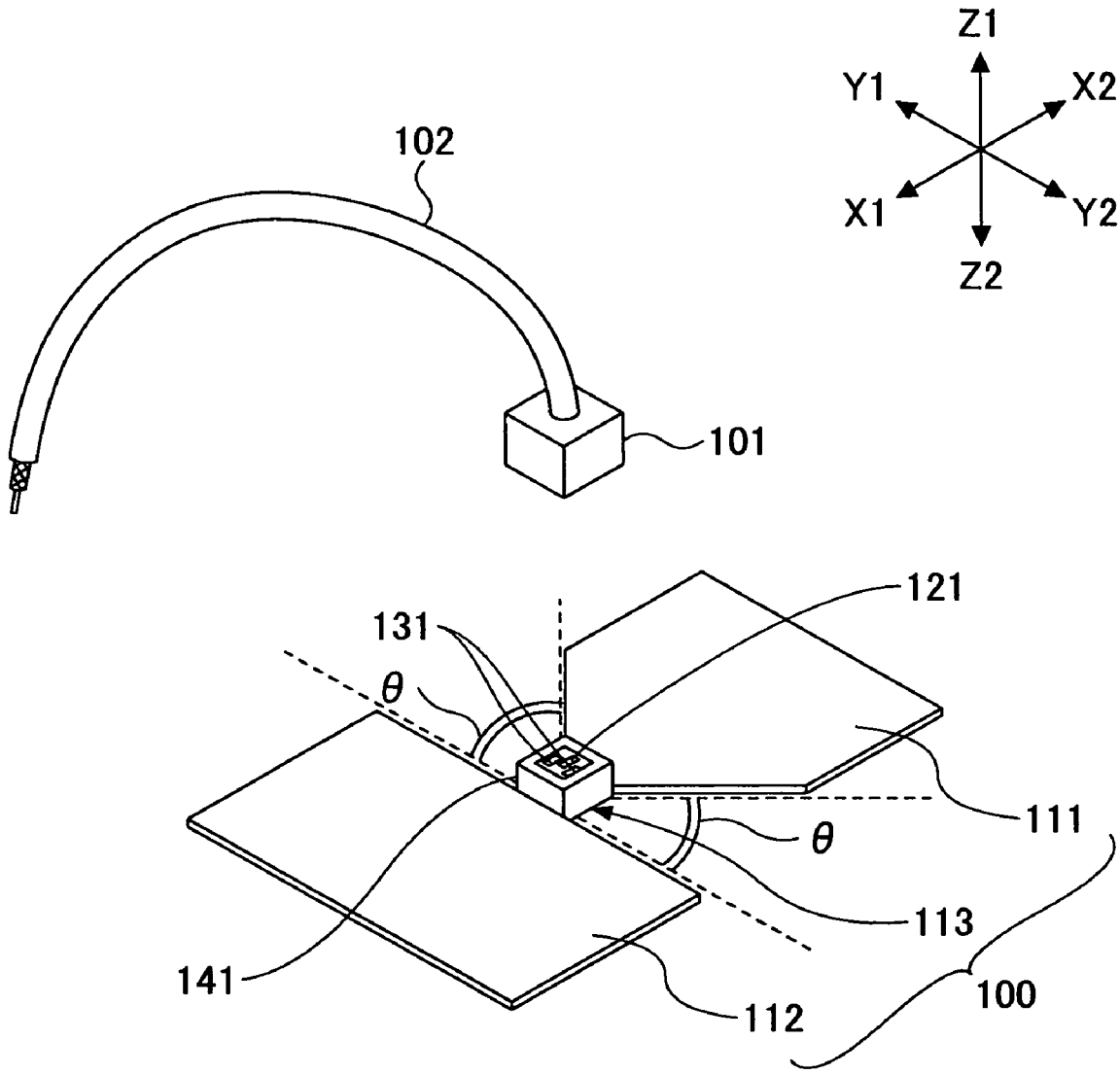
FIG. 1 is a perspective view of a first embodiment of the present invention.

FIG. 1 is a perspective view of a first embodiment of the present invention.

An antenna apparatus 100 according to the present embodiment is a UWB antenna that includes an element member 111, a ground member 112, and a connection part 113.

The element member 111 may be created by punching out a pentagon shape with side dimensions of several centimeters from a metal coil strip made of phosphor bronze, for example. In the present embodiment, an element terminal 121 of the connection part 113 is integrally formed with the element member 11 by punching out an extended portion extending from the tip of the element member 111. The ground member 112 may be created by punching out a rectangular shape with side dimensions of several centimeters from a metal coil strip made of phosphor bronze, for example. In the present embodiment, two sides of the pentagon-shaped element member 111 that meet at a feed point of the element member 111 are each arranged to form a predetermined angle θ with the side of the rectangular ground member 112 opposing the feed point.

The connection part 113 may be a socket connector that includes the element terminal 121, a ground terminal 131, and a resin part 141.

The element terminal 121 that is punched out with the element member 111 extends in the direction of arrow X1 from the feed point of the element member 111. In a subsequent process step, the punched element terminal 121 is slightly bent in the direction of arrow Z1 after which it is bent again to extend in the direction of arrow X1. The ground terminal 131 is integrally formed with the ground member 112 by punching out arm portions that extend in the direction of arrow X2 from the side of the ground member 112 opposing the feed point of the element member 111 in a manner such that the feed point is positioned between the arm portions of the terminal 131 with respect to directions Y1-Y2. In a subsequent process step, the arm portions of the ground terminal 131 are bent in the direction of arrow Z1 and then bent again in the direction of arrow X2.

The connection part 113 is configured to be connected to a plug connector 101. The plug connector 101 is connected to one end of a cable 102. By connecting the connection part 113 to the plug connector 101 that is connected to the cable 102, the antenna apparatus 100 may be connected to an external circuit via the connection part 113, the plug connector 101, and the cable 102. It is noted that the cable 102 may be a coaxial cable, for example.

The resin part 141 of the connection part 113 fixes the element member 111 and the ground member 112 at predetermined positions. In this way, a case and a sealer for fixing the element member 111 and the ground member 112 at predetermined positions may be unnecessary, for example.

It is noted that the gaps formed between the element terminal 121 and the ground terminal 131 may be adjusted such that an impedance of 50 Ω may be achieved, for example.

In the following, a method for fabricating the antenna apparatus 100 is described.

Figure 2:
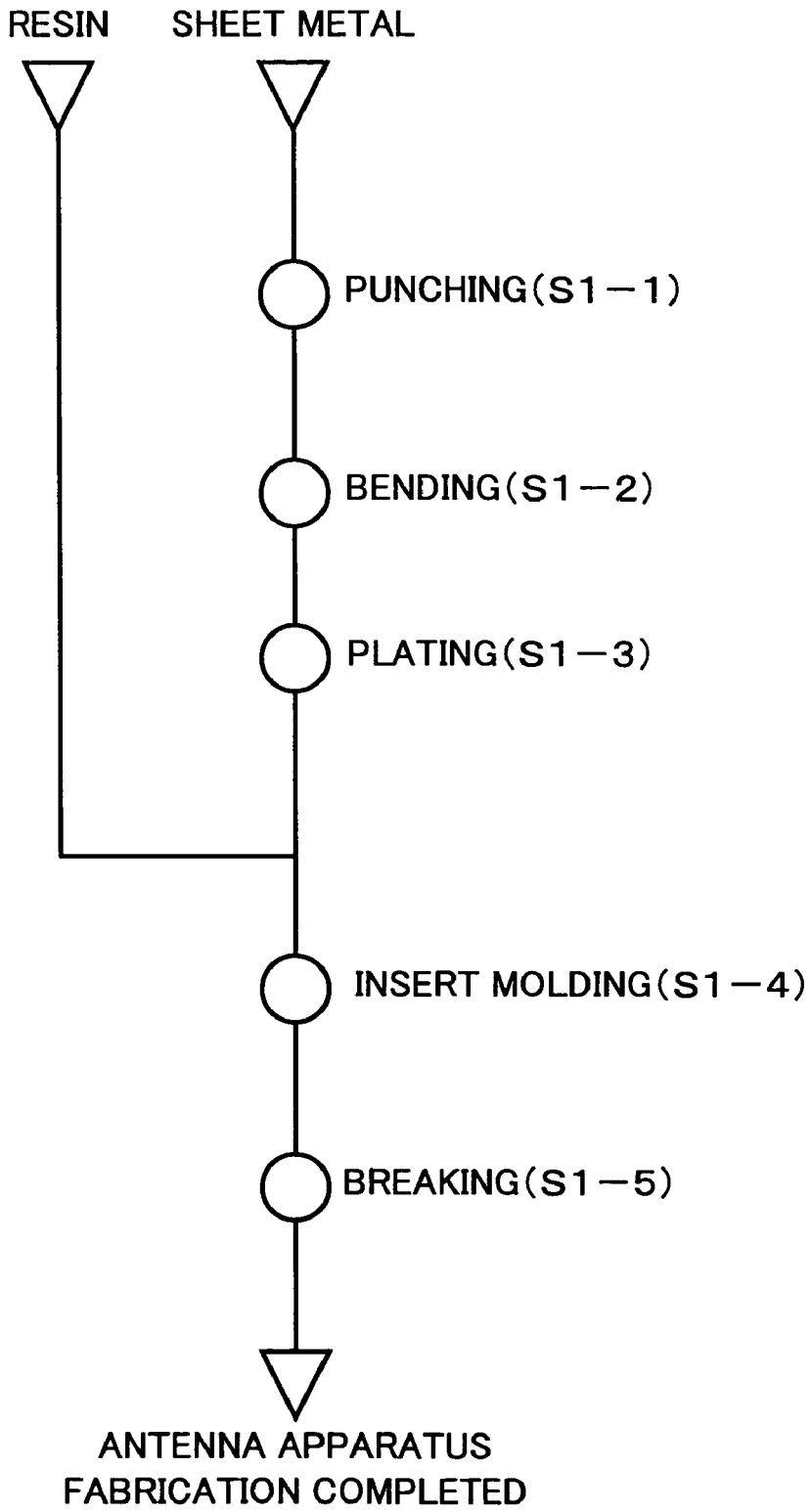
FIG. 2 is a flowchart showing process steps for fabricating the antenna apparatus of FIG. 1.

FIG. 2 is a flowchart illustrating process steps for fabricating the antenna apparatus 100. FIGS. 3A-3E are diagrams illustrating process stages for fabricating the antenna apparatus 100.

Figure 3A:
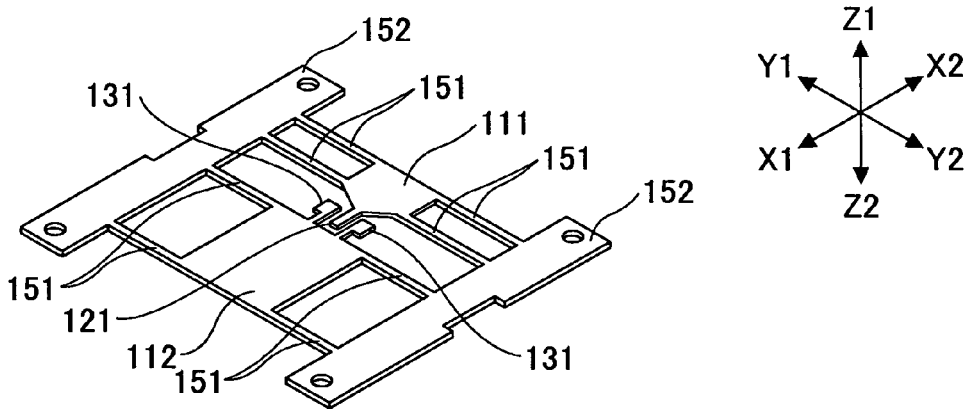
FIGS. 3A-3E are diagrams illustrating a method for fabricating the antenna apparatus of FIG. 1.
Figure 3B:
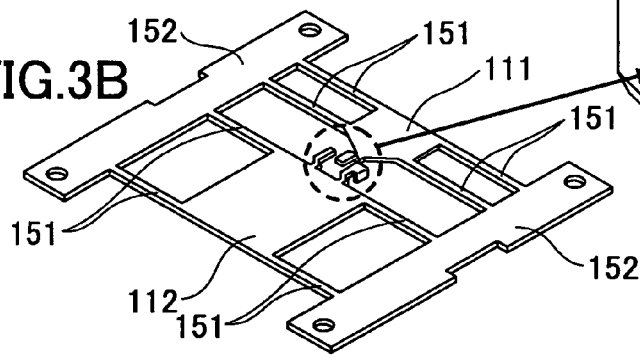
Figure 3C:
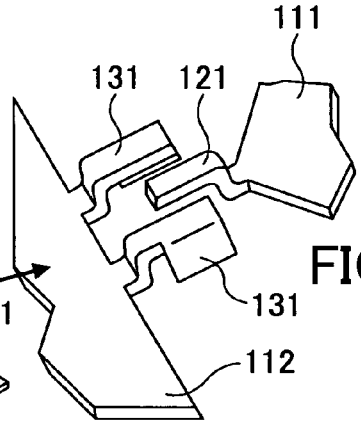
Figure 3D:
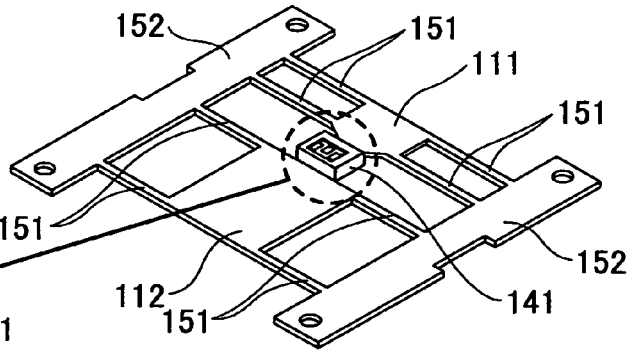
Figure 3E:
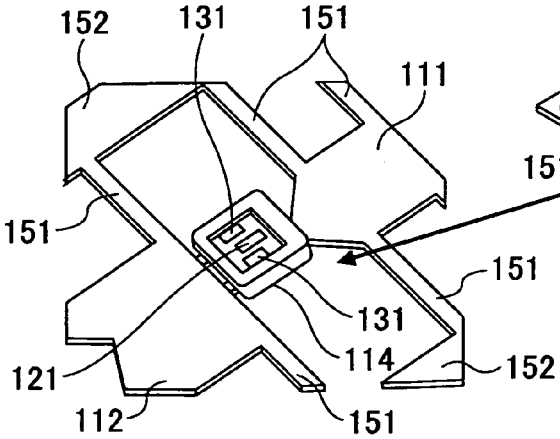

In step S1-1 of FIG. 2, a metal coil strip is punched using a die to create a structure as is shown in FIG. 3A, and in step S1-2, the element terminal 121 and the ground terminal 131 are bent as is shown in FIGS. 3B and 3C.

At this stage, the element member 111 and the ground member 112 are connected to a frame 152 by bridges 151. In this way, the element member 111 and the ground member 112 may be held in place to maintain a predetermined positional relationship with each other.

Then, in step S1-3, plating is applied to the overall structure. It is noted that the plating may be applied in order to prevent rusting, for example.

Then, in step S1-4, insert molding is performed by inserting resin material around the element terminal 121 and the ground terminal 131 to create the connection part 113. It is noted that the connection part 113 is molded into the shape of a socket connector that can engage the plug connector 101.

Then, in step S1-5, the element member 111 and the ground member 112 are broken away from the frame 152 by cutting the bridges 151.

Figure 4:
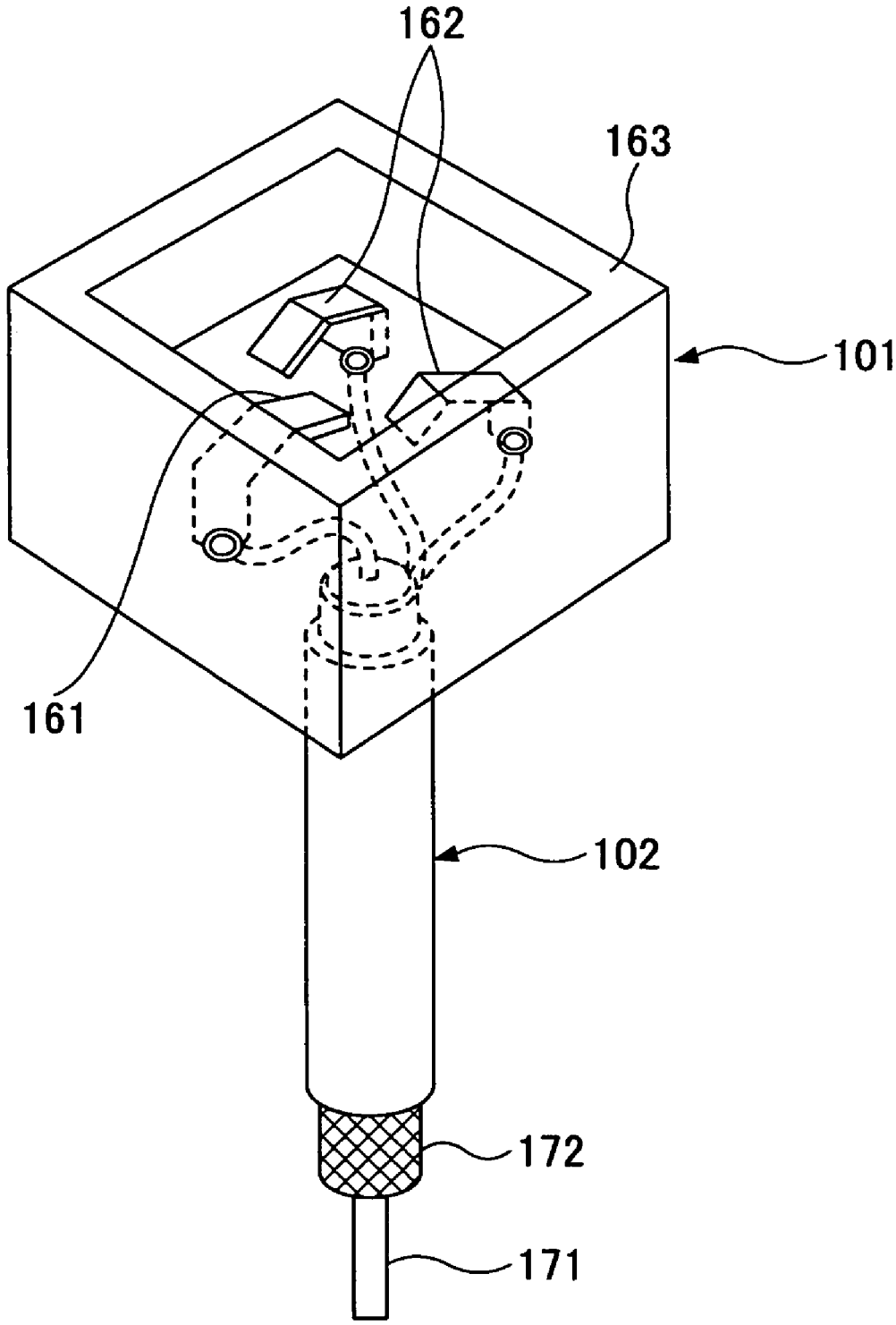
FIG. 4 is a perspective view of a plug connector used in the first embodiment.

FIG. 4 is a perspective view of the plug connector 101.

The plug connector 101 includes a signal terminal member 161, a ground terminal member 162, and a resin part 163. It is noted that a signal wire 171 is soldered to the signal terminal member 161. Also, a shield 172 of the cable 102 is soldered to the ground terminal member 162.

The signal terminal member 161 and the ground terminal member 162 are fixed at predetermined positioned by the resin part 163 so that they may come into contact with the element terminal 121 and the ground terminal 131 of the connection part 113 of the antenna apparatus 100. Also, the resin part 163 is shaped so that it can engage the resin part 141 of the connection part 113.

According to the present embodiment, the element terminal 121 that is integrally formed with the element member 111 and the ground terminal 131 that is integrally formed with the ground member 112 are bent into desired shapes after which resin material is inserted and molded into the shape of a connector through insert molding to create the connection part 113. In this way, a connector may be integrally formed with the element member 111 and the ground member 112 so that a connector as a separate component does not have to be individually mounted. Also, the resin material shaping the connection part 113 fixes the element member 111 and the ground member 112 so that they may maintain a predetermined positional relationship with each other.

Second Embodiment

Figure 5:
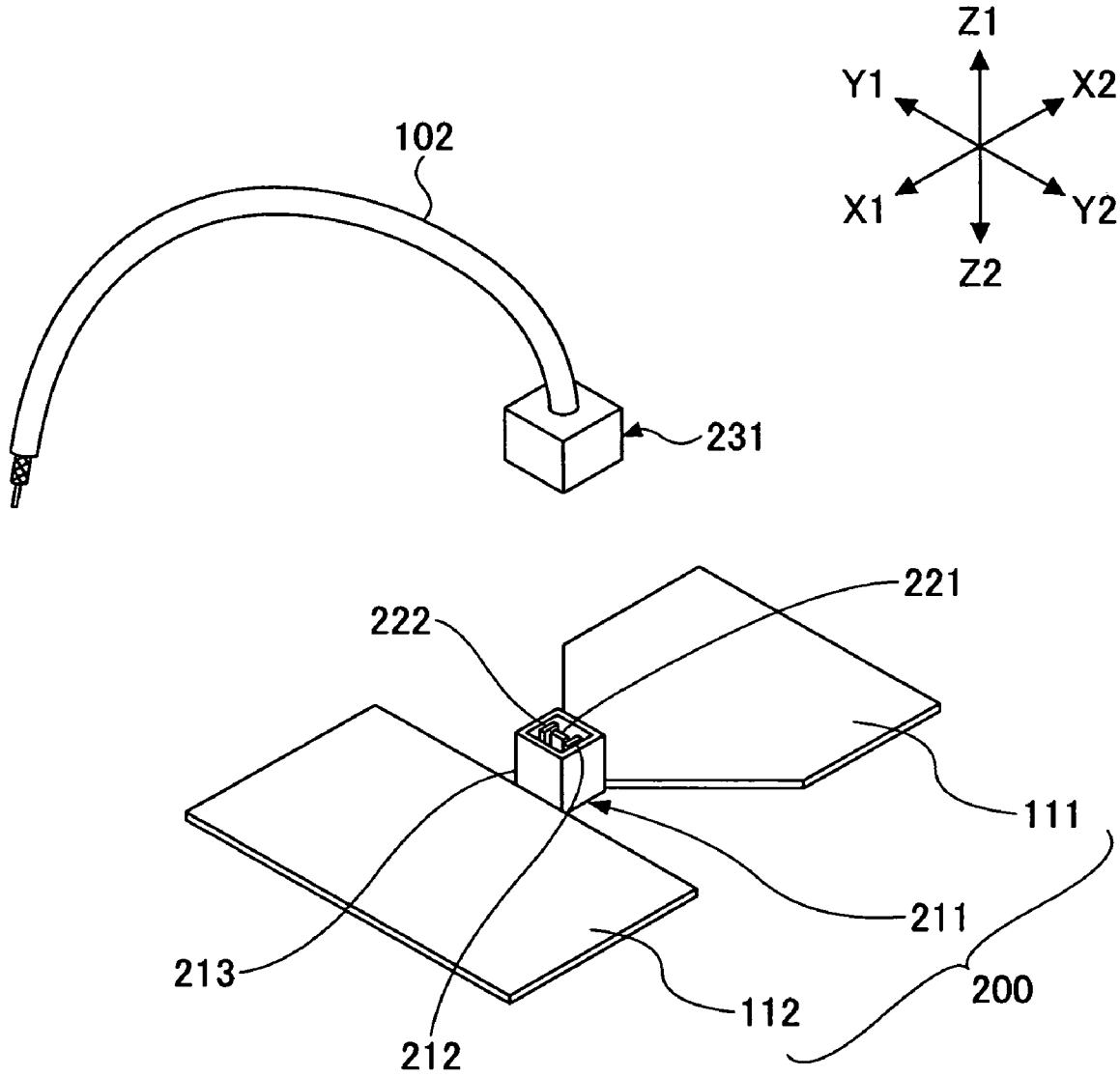
FIG. 5 is a perspective view of a second embodiment of the present invention.

FIG. 5 is a perspective view of a second embodiment of the present invention. It is noted that elements shown in this drawing that are identical to those shown in FIG. 1 are given the same reference numerals and their descriptions are omitted.

An antenna apparatus 200 according to the present embodiment has a connection part 211 that is different from that of the first embodiment. Specifically, the connection part 211 of the present embodiment includes an element terminal 221, a ground terminal 222, and a resin part 223. The element terminal 221 is integrally punched out with the element member 111 to extend in the direction of arrow X1 from the feed point of the element member 111. In a subsequent process step, the element terminal 221 is bent to extend in the direction of arrow Z1.

The ground terminal 222 is integrally punched out with the ground member 112 as arm portions extending in the direction of arrow X2 from the side of the ground member 112 opposing the element member 111, the feed point being positioned between the arm portions of the ground terminal 222 with respect to directions Y1-Y2. The punched arm portions of the ground terminal 222 are arranged to have L-shaped structures that extend in the X2 direction for a predetermined distance to then extend in the direction of arrow Y1 or Y2. In a subsequent process step, the sections of the ground terminal 222 extending in the direction Y1 or Y2 are bent to extend in the direction or arrow Z1.

The resin part 223 is arranged around the element terminal 221 and the ground terminal 222 and may be shaped through insert molding, for example.

In one preferred embodiment, the gaps formed between the element terminal 221 and the ground terminal 222 may be adjusted such that an impedance of 50 Ω may be obtained, for example.

FIGS. 6A-6E are diagrams illustrating process stages for fabricating the antenna apparatus 200.

Figure 6A:
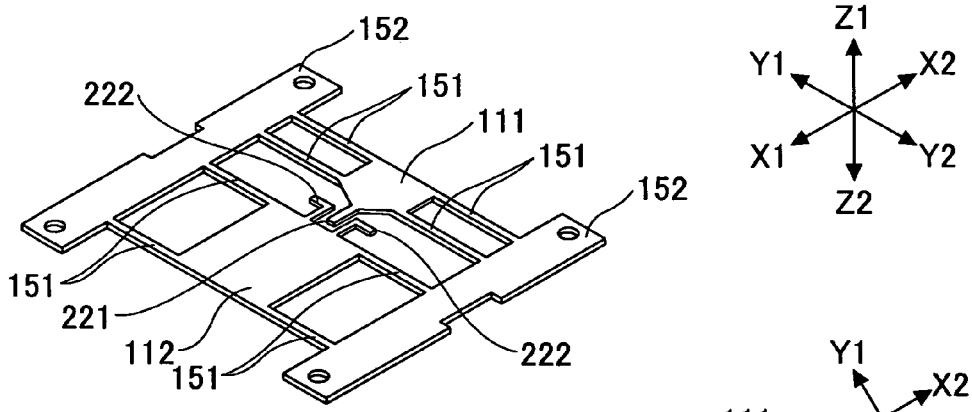
FIGS. 6A-6E are diagrams illustrating a method for fabricating the antenna apparatus of FIG. 5.
Figure 6B:
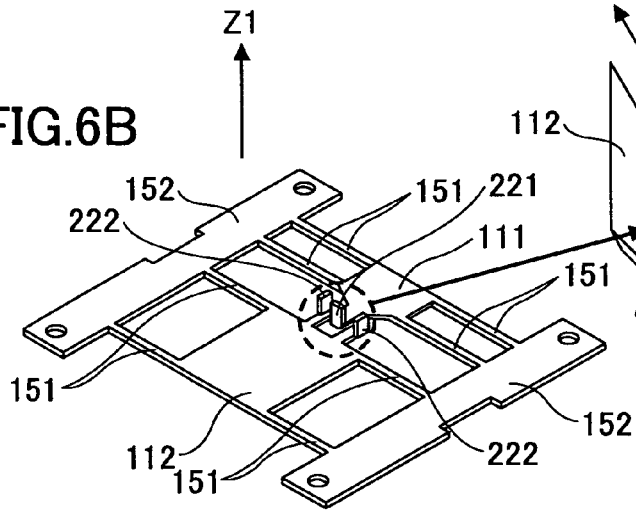
Figure 6C:
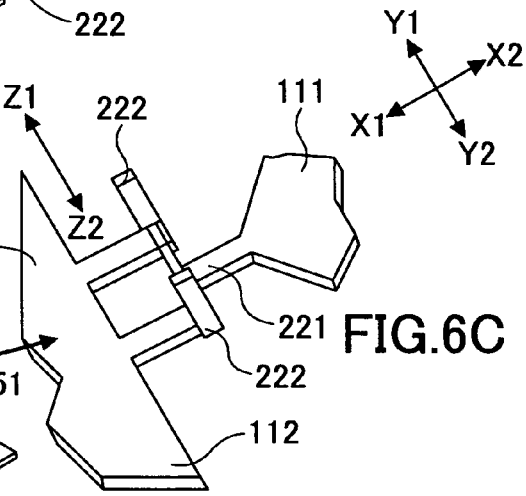
Figure 6D:
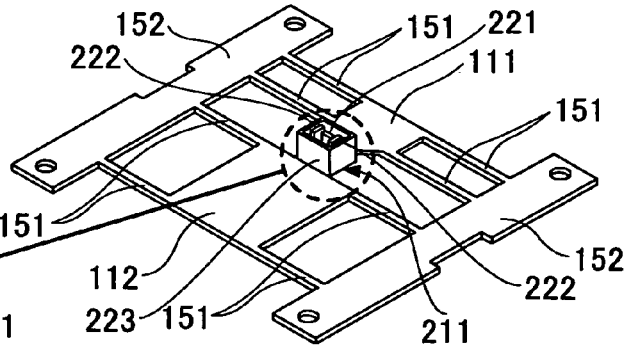
Figure 6E:
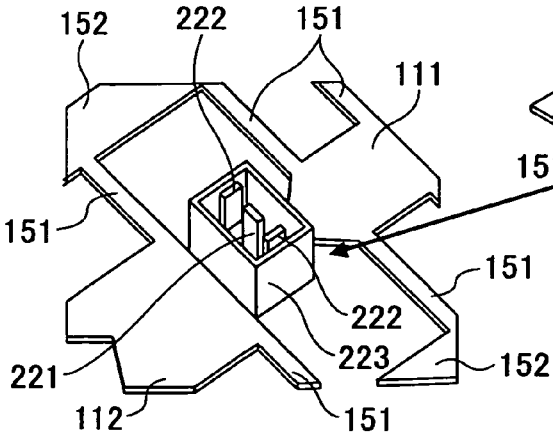

According to the present embodiment, the element member 111, the ground member 112, the element terminal 221, and the ground terminal 222 are punched using a die to create a structure as is shown in FIG. 6A. Then, the element terminal 221 and the ground terminal 222 are bent as is shown in FIGS. 6B and 6C.

Then, the element terminal 221 and the ground terminal 222 are fixed by the resin part 223 to form the connection part 211.

It is noted that the connection part 211 is configured to be attached to a plug connector 231.

Figure 7A:
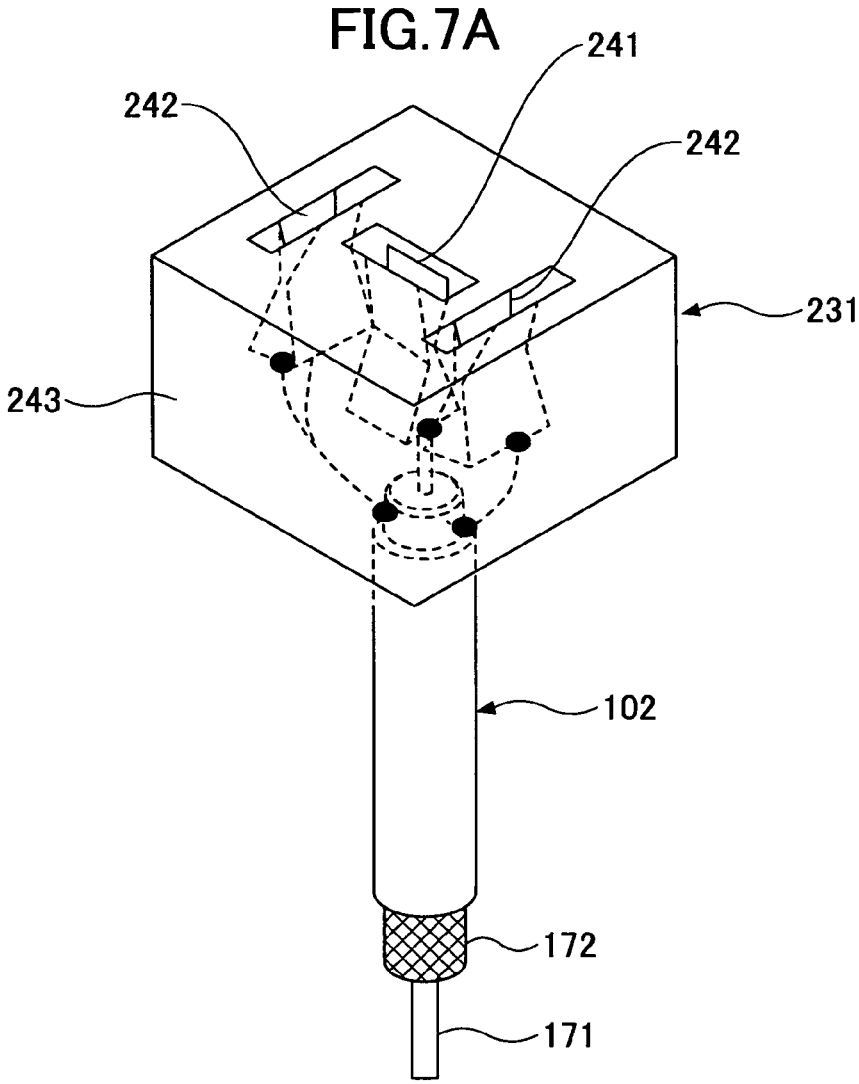
FIGS. 7A and 7B are perspective views of a plug connector used in the second embodiment.
Figure 7B:
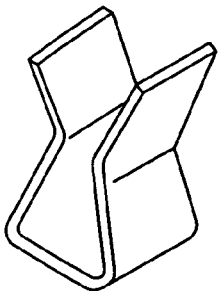

FIGS. 7A and 7B are diagrams illustrating the plug connector 231.

The plug connector 231 used in the present embodiment includes an element terminal member 241, a ground terminal member 242, and a resin part 243.

The element terminal member 241 may be a sheet metal that is arranged into a U-shape and soldered to the signal wire 171 of the cable 102, for example. The ground terminal member 242 may be a sheet metal that is arranged into a U-shape and soldered to a shield 172 of the cable 102.

It is noted that the resin part 243 fixes the element terminal member 241 and the ground terminal member 242 in place. Specifically, the resin part 243 fixes the positions of the element terminal member 241 and the ground terminal member 242 such that the element terminal 221 may engage the inner perimeter portion of the U-shaped element terminal member 241 and the ground terminal 222 may engage the inner perimeter portion of the U-shaped ground terminal member 242.

Third Embodiment

Figure 8A:
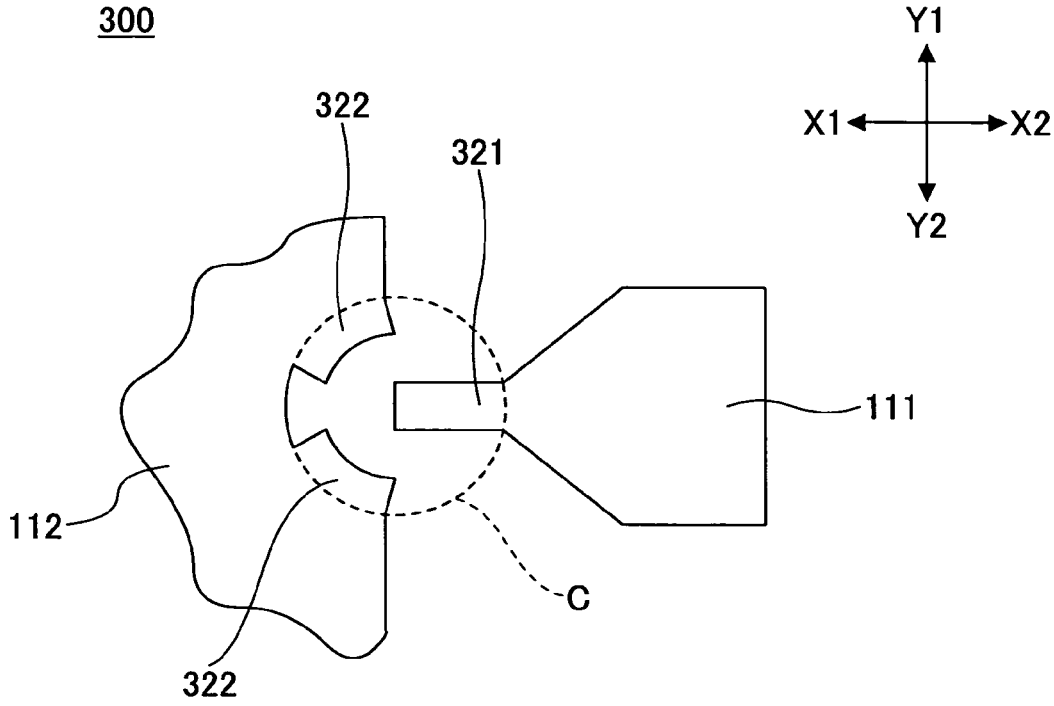
FIGS. 8A and 8B are diagrams showing relevant portions of a third embodiment of the present invention.
Figure 8B:
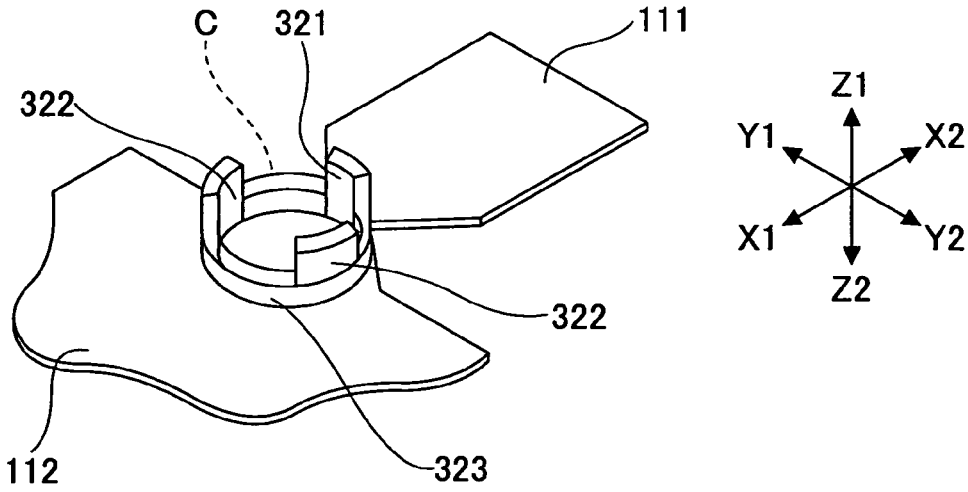

FIG. 8A is a plan view and FIG. 8B is a perspective view of relevant portions of a third embodiment of the present invention. It is noted that elements shown in these drawings that are identical to those shown in FIG. 1 are given the same numerical references and their descriptions are omitted.

An antenna apparatus 300 according to the present embodiment has a connection part 311 that differs from that of the first embodiment.

The connection part 311 of the present embodiment includes an element terminal 321, a ground terminal 322, and a resin part 323.

As is shown in FIG. 8A, the element terminal 321 is integrally punched out with the element member 111 to extend in the direction of arrow X1 from the feed point of the element member 111. In a subsequent process step, the element terminal 321 is bent along a hatched line C shown in FIG. 8A to extend in the direction of arrow Z1 as is shown in FIG. 8B.

As is shown in FIG. 8A, the ground terminal 322 is integrally punched out with the ground member 112 as portions extending toward the center of the circle defined by the hatched line C, the feed point being positioned between the extending portions of the ground terminal 322 with respect to directions Y1-Y2. In a subsequent process step, the extending portions of the ground terminal 322 are bent along the hatched line C to extend in the direction of arrow Z1 as is shown in FIG. 8B.

Figure 9:
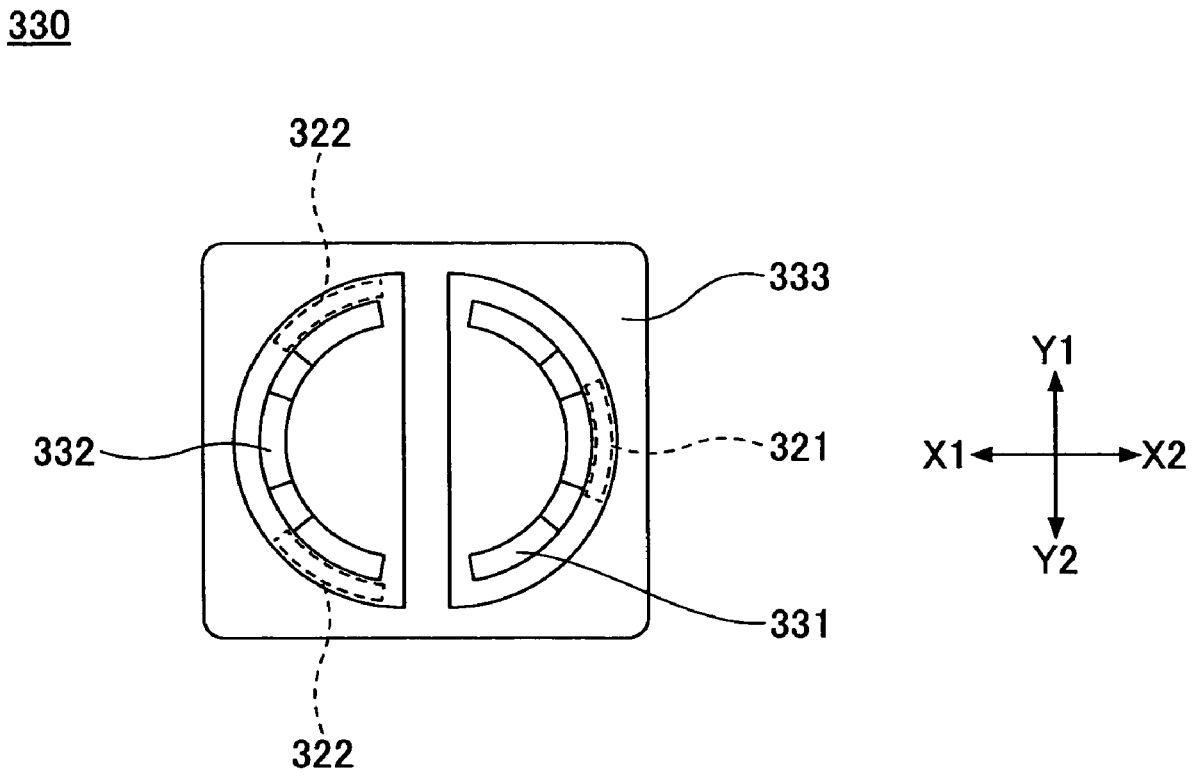
FIG. 9 is a plan view of a plug connector used in the third embodiment.

FIG. 9 is a plan view of a plug connector used in the present embodiment.

The plug connector 330 includes an element terminal member 331, a ground terminal member 332, and a resin part 333. The element terminal member 331 is arranged inside the resin part 333 to be connected to the signal wire 171 of the cable 102. The ground terminal member 332 is arranged inside the resin part 333 to be connected to the shield 172 of the cable 102.

The element terminal member 331 and the ground terminal member 332 are insulated by the resin part 333.

As is shown in FIG. 9, the element terminal 321 is press fit into the space between the element terminal member 331 and the resin part 333 so that the element terminal 321 and the element terminal member 331 may be connected. Also, the ground terminal 322 is press fit into the space between the ground terminal member 332 and the resin part 333 so that the ground terminal 322 and the ground terminal member 332 may be connected.

Fourth Embodiment

Figure 10A:
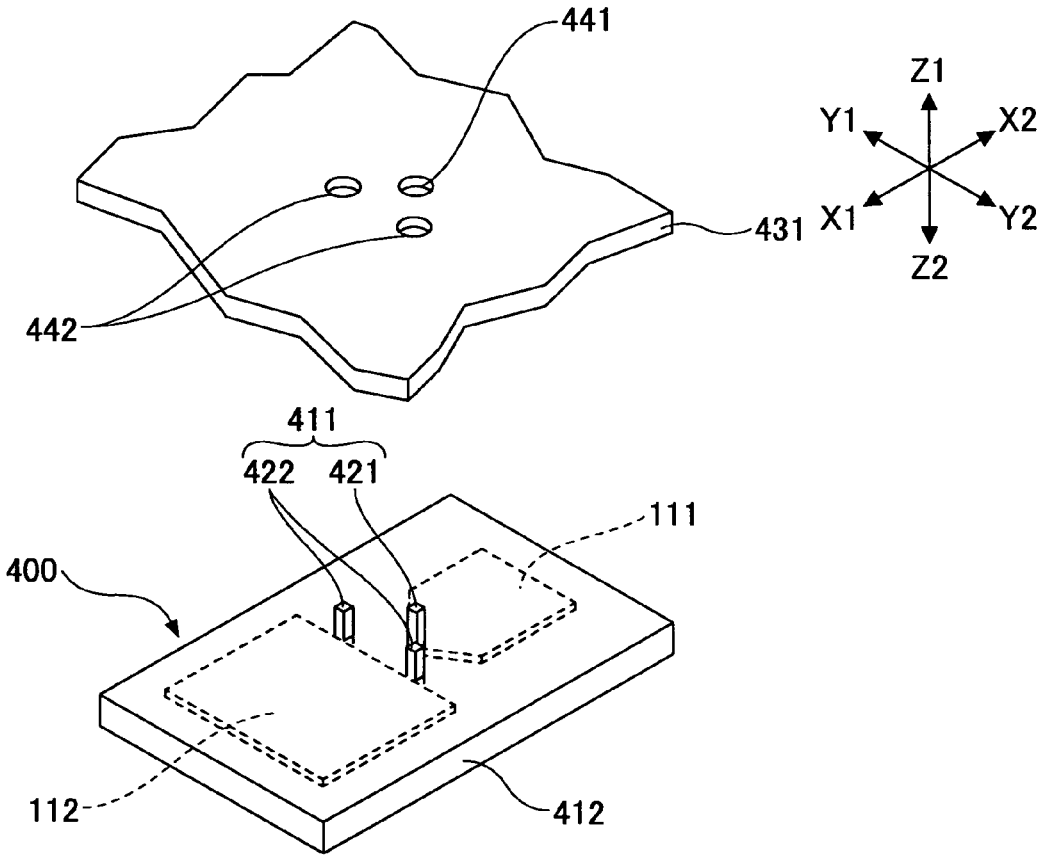
FIGS. 10A and 10B are perspective views of a fourth embodiment of the present invention.
Figure 10B:
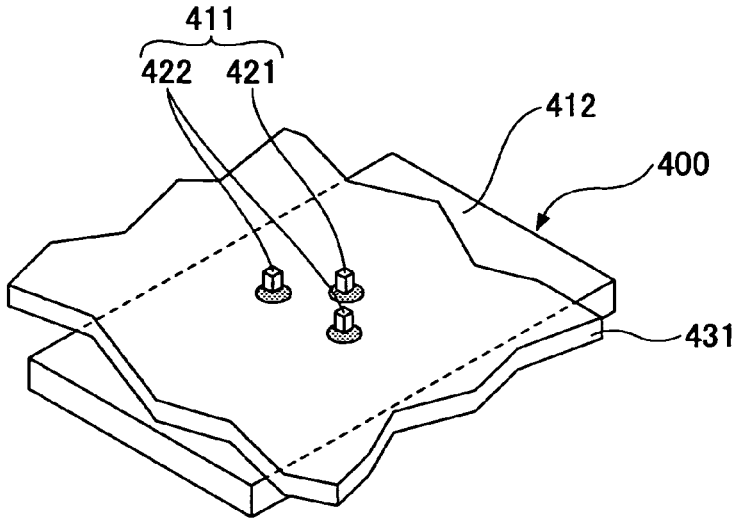
Figure 11A:
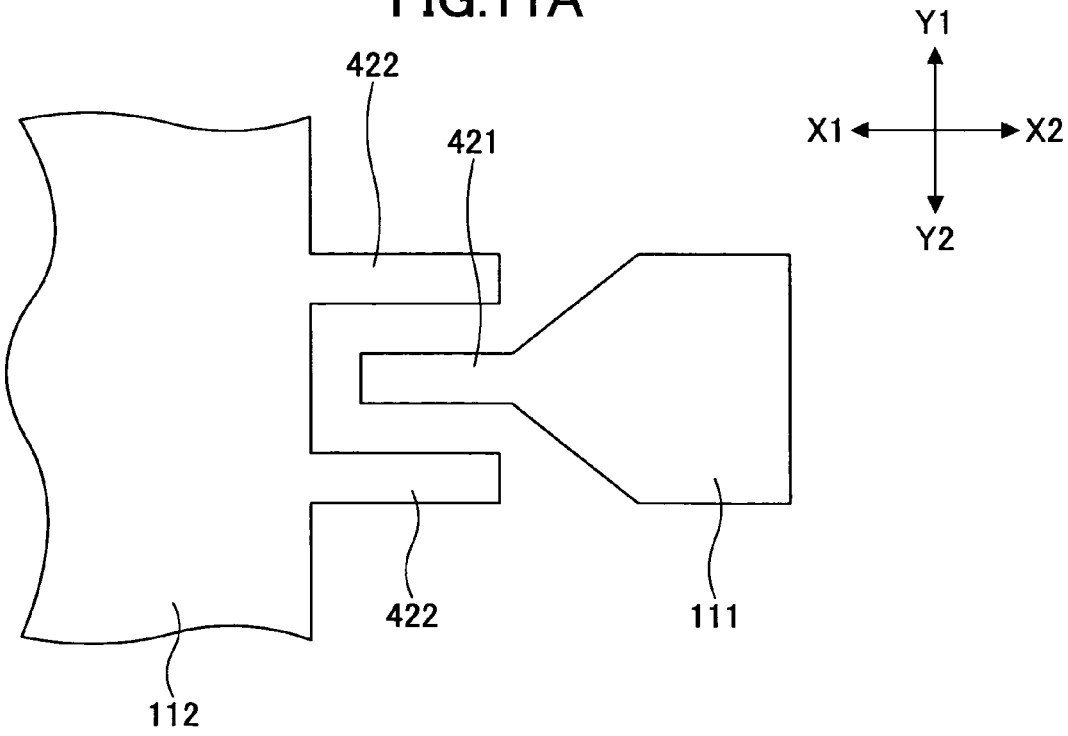
FIGS. 11A and 11B are diagrams showing relevant portions of the fourth embodiment.
Figure 11B:
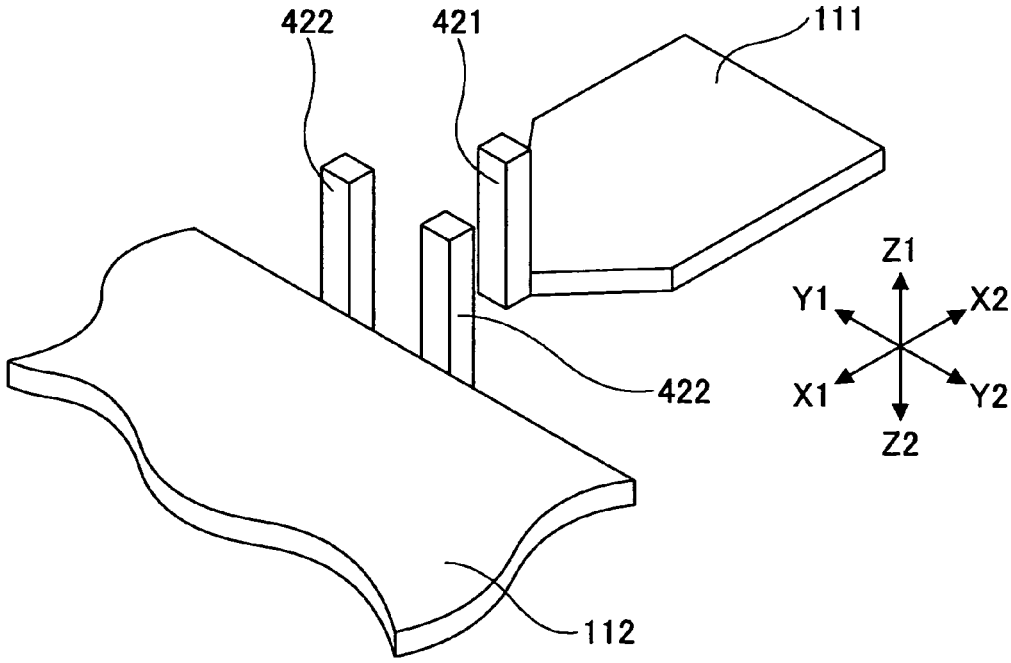

FIGS. 10A and 10B are perspective views of a fourth embodiment of the present invention, and FIGS. 11A and 11B are diagrams showing relevant portions of the fourth embodiment. It is noted that elements shown in these drawings that are identical to those shown in FIG. 1 are given the same numerical references and their descriptions are omitted.

An antenna apparatus 400 according to the present embodiment has a connection part 411 that is different from that of the first embodiment and a resin part 412 that seals the element member 111 and the ground member 112.

The connection part 411 includes an element terminal 421 and a ground terminal 422.

As is shown in FIGS. 11A and 11B, the element terminal 421 is integrally punched out with the element member 111 to extend in the direction of arrow X1 from the feed point of the element member 111. In a subsequent process step, the element terminal 421 is bent to extend in the direction of arrow Z1.

The ground terminal 422 is integrally punched out with the ground member 112 as arm portions extending in the direction of arrow X2 from the side of the ground member 112 opposing the element member 111, the feed point being positioned between the arm portions with respect to directions Y1-Y2. The ground terminal 422 is integrally punched out with the ground member 112 as L-shaped portions that extend in the direction of arrow X2 for a predetermined distance to then extend in the direction of arrow Y1 or Y2. In a subsequent process step, the sections of the ground terminal 422 extending in the direction Y1 or Y2 are bent to extend in the direction of arrow Z1.

As is shown in FIG. 10A, the element terminal 421 and the ground terminal 422 extend in the direction of arrow Z1 from the resin part 412. As is shown in FIG. 10B, the antenna apparatus 400 is mounted to a printed circuit board 431 by inserting the element terminal 421 and the ground terminal 422 through holes 441 and 441, respectively, from the Z2 side face of the printed circuit board 431, and soldering the element terminal 421 and the ground terminal 422 to the printed circuit board 431.

Fifth Embodiment

Figure 12A:
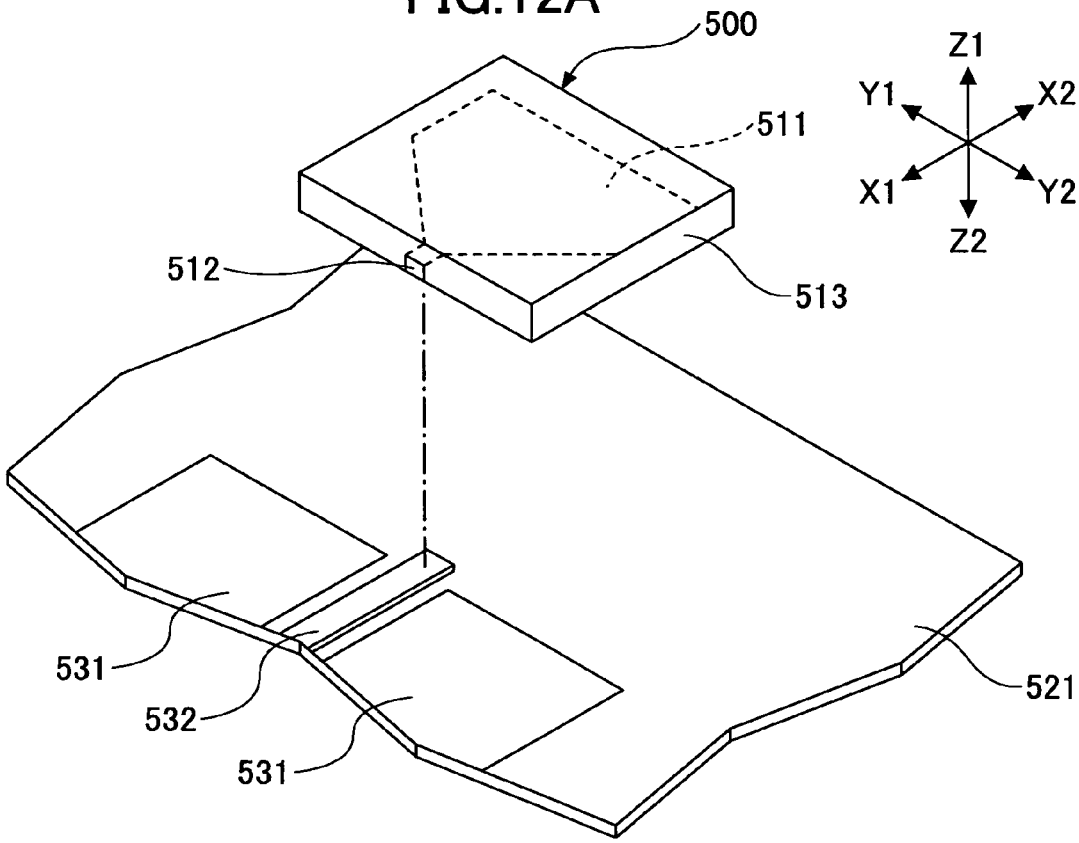
FIGS. 12A and 12B are perspective views of a fifth embodiment of the present invention.
Figure 12B:
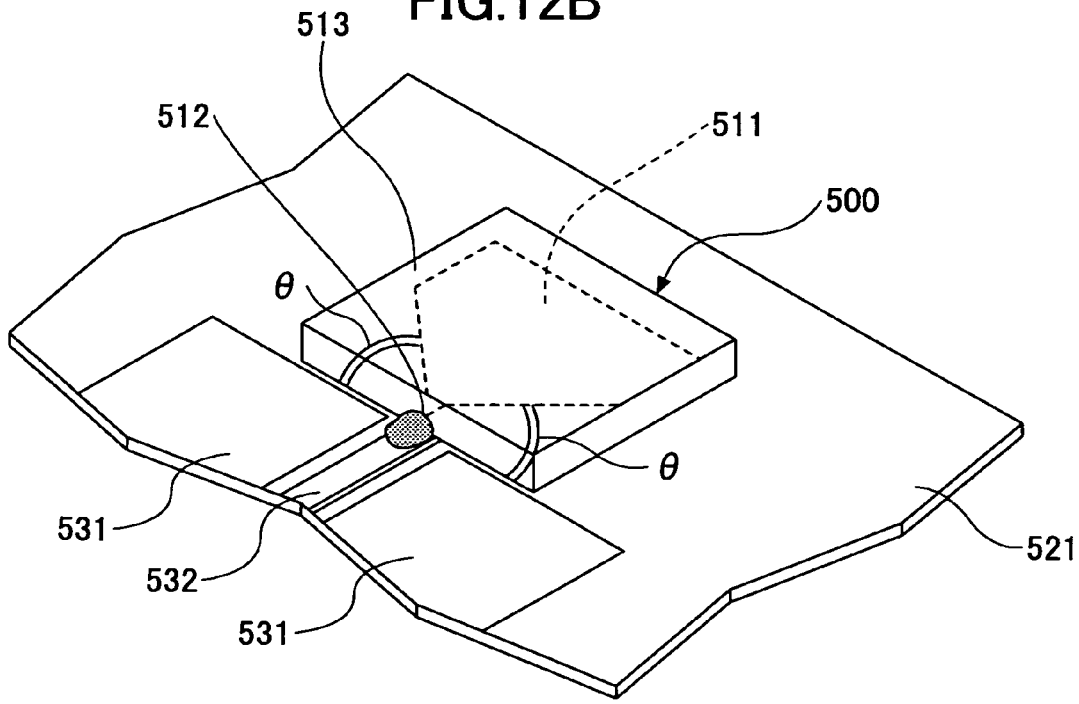
Figure 13A:
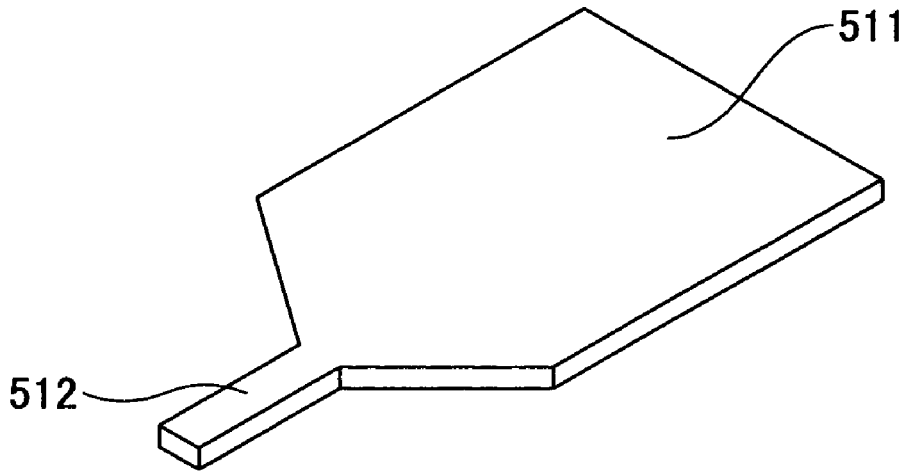
FIGS. 13A and 13B are diagrams showing relevant portions of the fifth embodiment.
Figure 13B:
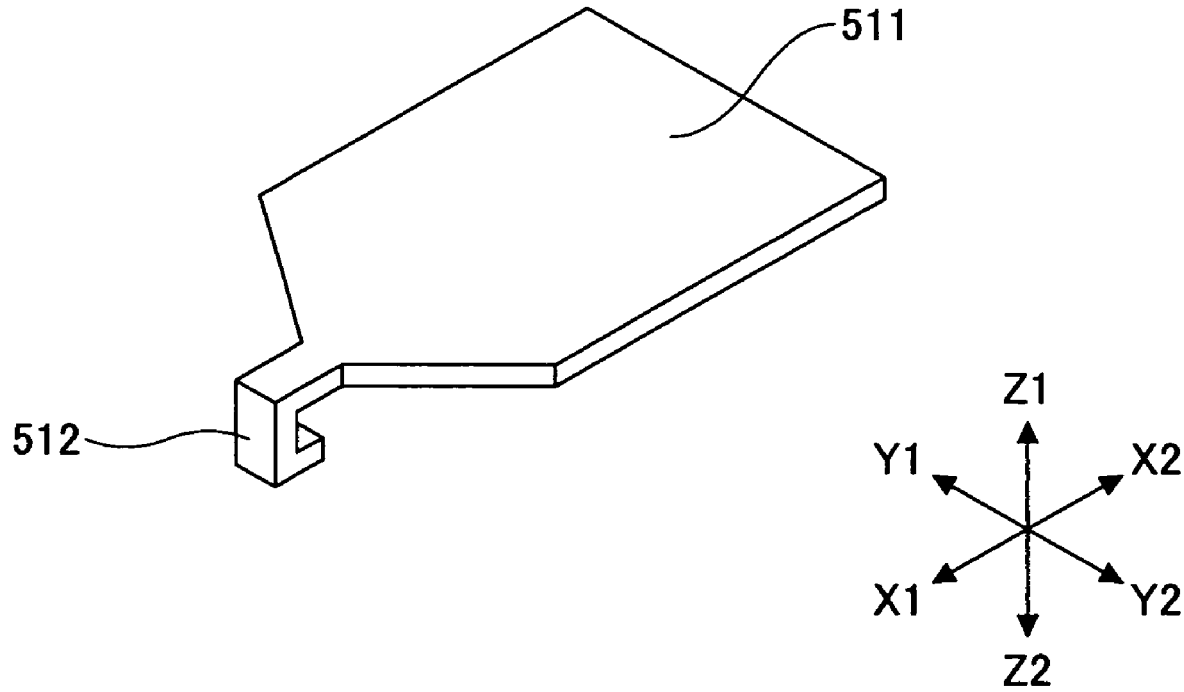

FIGS. 12A and 12B are perspective views of a fifth embodiment of the present invention. FIGS. 13A and 13B are diagrams showing relevant portions of the fifth embodiment.

An antenna apparatus 500 according to the present embodiment includes an element member 511, an element terminal 512, and a resin part 513. It is noted that the antenna apparatus 500 is configured to be surface mounted on a printed circuit board 521.

The element member 511 is created by punching out a pentagon shape with sides having dimensions of several centimeters from a metal coil strip made of phosphor bronze, for example. As is shown in FIG. 13A, the element terminal 512 is integrally punched out with the element member 511 to extend in the direction of arrow X1 from the feed point of the element member 511. In a subsequent process step, the element terminal 512 is bent to form a C-shape in side view as is shown in FIG. 13B.

The resin part 513 seals the element member 511 and the element terminal 512 in a manner such that the X1 side face and the Z2 side face of the element terminal 512 may be exposed through the resin part 513.

The printed circuit board 521 has a ground pattern 531 and a strip line 532 formed thereon. The element member 511 is positioned so that its sides form a predetermined angle θ with the side of the ground pattern 531. In this way, the element member 511 and the ground pattern of the printed circuit board 521 may form a UWB antenna.

According to the present embodiment, a miniaturized antenna apparatus may be fabricated.

Sixth Embodiment

Figure 14A:
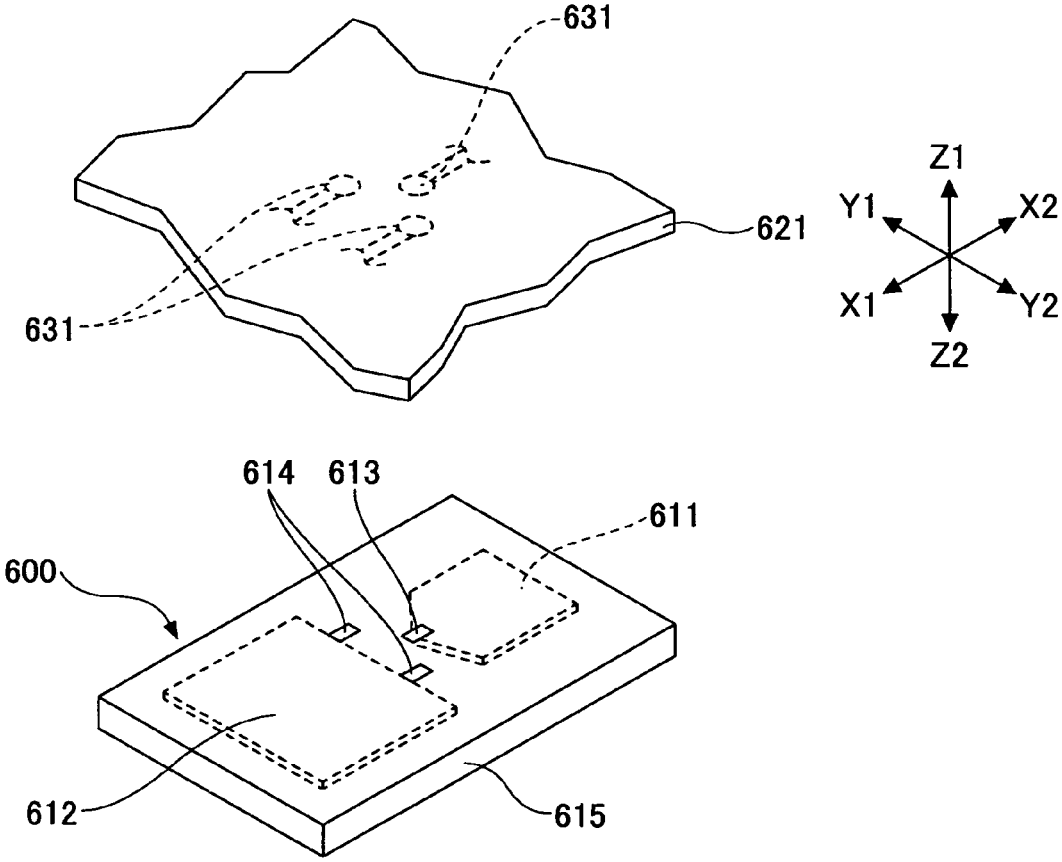
FIGS. 14A and 14B are perspective views of a sixth embodiment of the present invention.
Figure 14B:
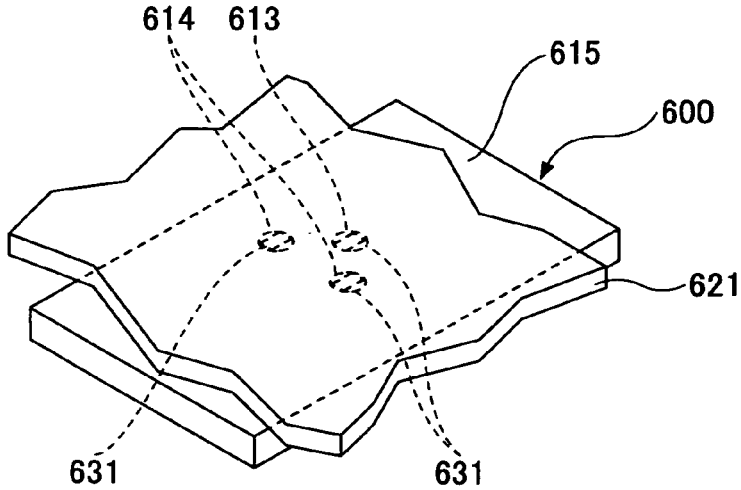
Figure 15A:
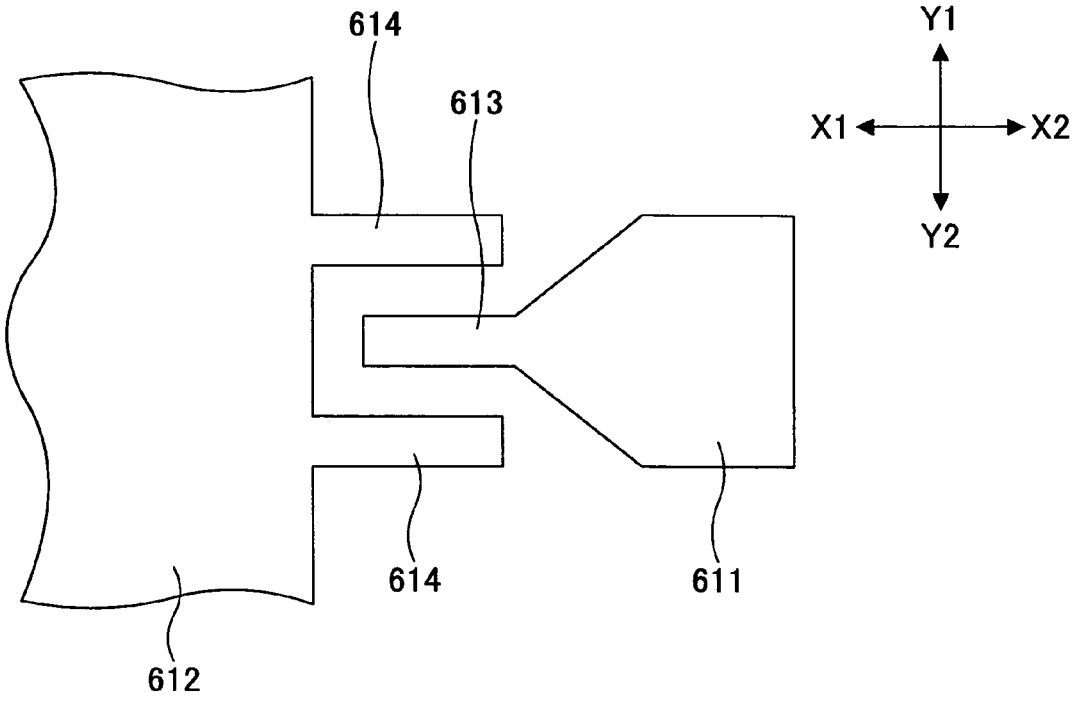
FIGS. 15A and 15B are diagrams showing relevant portions of the sixth embodiment.
Figure 15B:
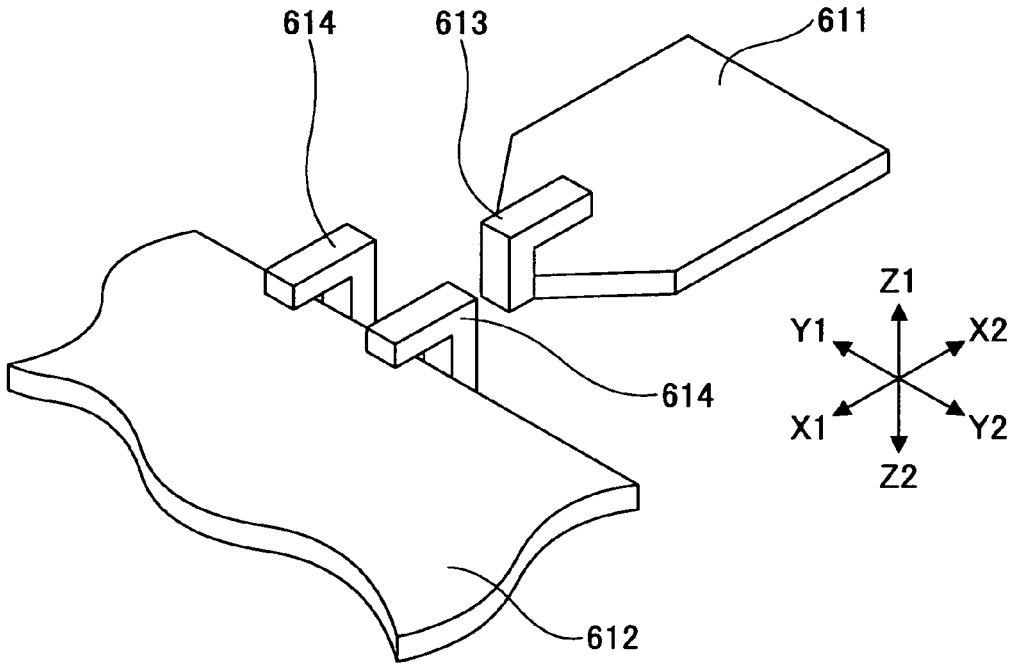

FIGS. 14A-14C are perspective views of a sixth embodiment of the present invention, and FIGS. 15A and 15B are diagrams showing relevant portions of the sixth embodiment.

An antenna apparatus 600 according to the present embodiment includes an element member 611, a ground member 612, an element terminal 613, a ground terminal 614, and a resin part 615. The antenna apparatus 600 is configured to be surface mounted on a printed circuit board 621.

The element member 611 and the ground member 612 have shapes identical to those of the element member 111 and the ground member 112 according to the first embodiment. Specifically, the element member 611 is created by punching out a pentagon shape with sides having dimensions of several centimeters from a metal coil strip made of phosphor bronze, for example, and the element terminal 613 is integrally formed with the element member 611 to extend from the feed point of the element member 611. As is shown in FIG. 15A, the element terminal 613 is punched out with the element member 611 to extend in the direction of arrow X1 from the feed point of the element member 611. In a subsequent process step, the element terminal 611 is bent to form a C-shape in side view as is shown in FIG. 15B. As is shown in FIG. 15A, the ground terminal 614 is integrally punched out with the ground member 612 as arm portions extending in the direction of arrow X2 from the side of the ground member 612 opposing the feed point of the element member 611, the feed point being positioned between the arm portions of the ground terminal 614 with respect to directions Y1-Y2. In a subsequent process step, the arm portions are bent to form a C-shape in side view as is shown in FIG. 15B.

The resin part 615 seals the element member 611, the ground member 612, the element terminal 613, and the ground terminal 614 in a manner such that the Z2 side faces of the element terminal 613 and the ground terminal 614 may be exposed through the resin part 615.

The printed circuit board 621 has an antenna connection land 631 formed thereon. The antenna apparatus 600 may be surface mounted on the printed circuit board 621 by soldering the Z2 side faces of the element terminal 613 and the ground terminal 614 to the antenna connection land 631, for example.

In the present embodiment, the element member 611 and the ground member 612 are fixed by the element terminal 613 and the ground terminal 614. However, in a modified embodiment, resin may be used to seal and fix the element member 611 and the ground member 612. It is noted that by sealing the element member 611 and the ground member 612 with resin, the antenna apparatus may be miniaturized owing to the wavelength reduction effect.

It is noted that in the antenna apparatuses according to preferred embodiments of the present invention as described above, the element member (antenna element) is distinguished from the ground member, and the ground member is connected to ground. However, in other embodiments where balanced feeding is performed on the antenna element and the ground member, the ground member may not be connected to ground, and the antenna element and the ground member may function as a dipole antenna apparatus, for example.

Further, although the above-embodiments of the present invention are described as UWB antenna apparatuses, the present invention may generally be applicable to any type of antenna apparatus that uses an element member made of sheet metal, for example.

It is noted that the present invention is not limited to the above-described embodiments, and variations and modifications may be made without departing from the scope of the present invention.

The present application is based on and claims the benefit of the earlier filing date of Japanese Patent Application No. 2006-257782 filed on Sep. 22, 2006, the entire contents of which are hereby incorporated by reference.

What is claimed is:

1. An antenna apparatus, comprising:

an element member made of sheet metal;

a ground member made of sheet metal, the ground member being coplanar with the element member; and a connection part that connects the element member and the ground member and that is integrally formed with the element member and the ground member;

wherein an element terminal that is formed integrally with the element member and bent into a predetermined shape;

a ground terminal that is formed integrally with the ground member and bent into a predetermined shape, and the connection part is formed by deforming the element terminal and the ground terminal and coating a resin material around the deformed element terminal and ground terminal.

2. The antenna apparatus as claimed in claim 1, wherein the connection part further includes a resin part including the resin coating; and the element terminal, the ground terminal, and the resin part form a connector.

3. The antenna apparatus as claimed in claim 2, wherein the resin part fixes the element member and the ground member.

4. The antenna apparatus as claimed in claim 1, wherein the element member and the ground member are sealed by the resin; and a portion of the element terminal and a portion of the ground terminal are exposed through the resin.

5. The antenna apparatus as claimed in claim 1, wherein the element member, the ground member, and the connection part are adapted for broadband/ultra-wide band wave transmission/reception.

6. The antenna apparatus as claimed in claim 1, wherein at least two sides of the element member that meet at a feed point of the element member are each arranged to form a non-zero angle with a side of the ground member that opposes the feed point.

* * * * *